US010047945B2

(12) United States Patent
Gielen et al.

(10) Patent No.: US 10,047,945 B2
(45) Date of Patent: Aug. 14, 2018

(54) LIGHTING DEVICE

(71) Applicant: PHILIPS LIGHTING HOLDING B.V., Eindhoven (NL)

(72) Inventors: Vincent Stefan David Gielen, Eindhoven (NL); Jan De Graaf, Eindhoven (NL); Brian David Clarke, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/507,842

(22) PCT Filed: Aug. 25, 2015

(86) PCT No.: PCT/EP2015/069383
§ 371 (c)(1),
(2) Date: Mar. 1, 2017

(87) PCT Pub. No.: WO2016/034452
PCT Pub. Date: Mar. 10, 2016

(65) Prior Publication Data

US 2017/0299169 A1 Oct. 19, 2017

Related U.S. Application Data

(60) Provisional application No. 62/044,513, filed on Sep. 2, 2014.

(30) Foreign Application Priority Data

Sep. 29, 2014 (EP) ..... 14186858

(51) Int. Cl.
*F21V 29/74* (2015.01)
*F21V 1/02* (2006.01)
(Continued)

(52) U.S. Cl.
CPC ..... *F21V 29/74* (2015.01); *F21K 9/235* (2016.08); *F21K 9/237* (2016.08); *F21K 9/238* (2016.08);
(Continued)

(58) Field of Classification Search
CPC ... F21V 29/74; F21V 1/02; F21V 3/02; F21V 7/22; F21K 9/235; F21K 9/237; F21Y 2105/18; F21Y 2115/10
(Continued)

(56) References Cited

U.S. PATENT DOCUMENTS 3,936,686 A 2/1976 Moore
2008/0025020 A1 1/2008 Kolb
(Continued)

FOREIGN PATENT DOCUMENTS

CN 202546362 U 11/2012
EP 2251587 A1 11/2010
(Continued)

*Primary Examiner* — Laura Tso

(57) ABSTRACT

The invention relates to a lighting device kit of parts comprising a lamp (3) and a lamp shade (5). The lamp (3) of the lighting device comprises a light source (11) and a heat sink area (13) comprising a main heat dissipating surface (15). The lamp shade (5) of the lighting device comprises a shade structure (17) conjoined via a thermal path part with a cooling structure (21) comprising a main surface (24). In a mounted position of the lamp shade (5) and the lamp (3), the main surface (24) of the cooling structure (21) adjoins the main heat dissipating surface (15) of the heat sink area (13). The invention further relates to a lamp and a lamp shade of said lighting device kit of parts.

12 Claims, 4 Drawing Sheets

(51) Int. Cl.

| | |
|---|---|
| ***F21K 9/235*** | (2016.01) |
| ***F21V 3/02*** | (2006.01) |
| ***F21K 9/238*** | (2016.01) |
| ***F21V 7/22*** | (2018.01) |
| ***F21K 9/237*** | (2016.01) |
| *F21Y 115/10* | (2016.01) |
| *F21Y 105/18* | (2016.01) |

(52) U.S. Cl.
CPC ..... *F21V 1/02* (2013.01); *F21V 3/02* (2013.01); *F21V 7/22* (2013.01); *F21Y 2105/18* (2016.08); *F21Y 2115/10* (2016.08)

(58) Field of Classification Search
USPC ..... 362/294, 251, 253
See application file for complete search history.

(56) References Cited

U.S. PATENT DOCUMENTS

| | | | | |
|---|---|---|---|---|
| 2008/0084700 | A1 | 4/2008 | Van De Ven | |
| 2008/0112170 | A1 | 5/2008 | Trott | |
| 2008/0291631 | A1 | 11/2008 | Hellinger et al. | |
| 2016/0161100 | A1* | 6/2016 | Kimoto ..... | F21V 7/0083 362/234 |

FOREIGN PATENT DOCUMENTS

| | | | |
|---|---|---|---|
| GB | 1494493 | A | 12/1977 |
| JP | 2011065795 | A | 3/2011 |
| WO | 2006057151 | A1 | 6/2006 |

* cited by examiner

LIGHTING DEVICE

CROSS-REFERENCE TO PRIOR APPLICATIONS

This application is the U.S. National Phase application under 35 U.S.C. § 371 of International Application No. PCT/EP2015/069383, filed on Aug. 25, 2015 which claims the benefit of U.S. Provisional Patent Application No. 62/044,513, filed on Sep. 2, 2014 and European Patent Application No. 14186858.8, filed Sep. 29, 2014. These applications are hereby incorporated by reference herein.

FIELD OF THE INVENTION

The invention relates to a lighting device kit of parts comprising a lamp and a lamp shade. The invention further relates to a lamp and a lamp shade of said lighting device kit of parts.

BACKGROUND OF THE INVENTION

Such a lighting device kit of parts is known from EP2251587A1. In the known lighting device, the light source is a LED which is connected via a conjoint surface to its heat sink, i.e. a plurality of heat dissipating fins. Said heat dissipating fins extend in radial directions and are circumferentially evenly distributed around the light source. Extreme ends of the fins, i.e. parts of the fins which are in radial direction most remote from the light source, contact a reflective lamp shade. Heat generation and subsequent heat dissipation is a well-known issue for LED light sources. Often there is a mismatch between the size of the LED and the size of its heat sink, thus frustrating the wide variety in, often subtle, design possibilities that the tiny LED light sources offer. Also the lighting device disclosed in EP2251587A1 has the disadvantage of inefficient use of cooling possibilities and hence the disadvantage of a relatively large heat sink compared to the size of the LED light source. Furthermore, the provision of said heat sink renders the known lighting device to have the disadvantage of being relatively expensive. Another disadvantage of the known lighting device is that the heat dissipating fins are positioned in between the light source and the reflective lamp shade, thus said fins intercept some light and increase the number of reflections inside the lighting device. As with each reflection some light is lost and due to said interception of light, the known lighting device has the disadvantage that its efficacy is relatively low.

SUMMARY OF THE INVENTION

It is an object of the invention to counteract at least one of the disadvantages of the known lighting device kit of part. Thereto the lighting device kit of part according to the invention comprises: a lamp comprising a light source and a heat sink area comprising a main heat dissipating surface; a lamp shade comprising a shade structure conjoined via a thermal path with a cooling structure comprising a main surface; in a mounted position of the lamp shade and the lamp, the main surface of the cooling structure adjoins the main heat dissipating surface of the heat sink area, and the light source is arranged around the heat dissipating surface. Conjoined means to express that the shade structure and the cooling structure are associated entities which are mutually connected via the thermal path. Adjoins means to express that the main surface of the cooling structure and the main heat dissipating surface of the heat sink area lie adjacent to another and contact each other with their respective main surfaces, essentially over a large part of their main surfaces, for example for at least 50%, but preferably for at least 80%, or even for at least 95%. In the lighting device of the invention relatively very efficient heat dissipation is attained, because heat from the light source is efficiently transferred from the heat sink of the light source via the cooling structure and the thermal path to the shade structure of the lamp shade. Hence, cooling of the light source is not obtained by only the heat sink, but additionally the shade structure of the lamp shade is used for this cooling. Said efficient cooling involves efficient transfer from the heat sink area of the light source to the cooling structure of the lamp shade, which is attained because of the relatively large contact surface area between the main heat dissipating surface of the heat sink and the main surface of the cooling structure of the lamp shade. The arrangement of the light source around the heat dissipating surface has the advantage that during operation of the lighting device, light from the light source essentially is not blocked by the heat sink in a radial direction towards the lamp shade, hence enabling a more efficient lighting device, yet with efficient cooling. It is convenient to concentrically arrange the light source and the heat dissipating surface.

Often the material of the thermal path, via which the cooling structure and the lamp shade area are conjoined, has a value of specific thermal conductivity of at least 10 W/(m.K), i.e. values that are generally obtained by iron alloys, stainless steel or lead. More preferably the value of said specific heat conductivity is at least 100 W/(m.K), i.e. values that are generally obtained with graphene, aluminum alloys, aluminum, copper and silver. It is also favorable if at least one, but preferably both, of the lamp shade structure and the cooling structure are made of said thermal conductive material. As the lamp shade in the lighting device of the invention has a double-function, i.e. used for shading of the light source and is used for additional heat dissipation, the mismatch between the size of the LED and the size of its heat sink can be reduced. Hence, with the lighting device of the invention the advantage is obtained of enabling a wider variety in the, often subtle, design possibilities that the tiny LED light sources offer than with the known lighting devices. As the cooling structure is not located in between the light source and the reflective shade, said cooling structure neither intercepts light originating from the light source nor increases the number of internal reflections, and hence the efficacy of the lighting device according to the invention is relatively high.

Mutual mounting of the lamp and the lamp shade can, for example, be realized via a socket of the lamp. The socket can be a conventional E27 screw thread lamp foot on which the lampshade can be screwed or, for example, be clamped when the lamp foot is screwed into an E27 lamp fitting. To further increase the cooling efficiency, the lighting device kit of parts according to the invention is further characterized in that the thermal path has a cross-sectional width Wp which is at least 25%, for example ⅓, of the largest cross-sectional width Ws of the main surface of the cooling structure. As the thermal path part can be considered a bottle-neck for heat transfer from the heat sink to the lamp shade structure, a relatively large width of the neck (thermal path part) compared to the width of the cooling structure, enhances the efficiency of said efficient heat transfer.

To increase optical efficiency the inner surface of the lamp shade preferably is reflective and more preferably has a reflectivity of at least 80%, which can be obtained by chemically, or mechanically polishing and anodizing, but even more preferably said reflectivity is at least 90%. A high reflection of at least 95%, for example about 98%, can be obtained by adding a silver coating and/or a stack of interference layers. Alternatively, the inner surface of the lamp shade can be coated with a (diffuse) reflective coating, e.g. a white reflective paint or a powder coating.

For the ease of manufacturing, a lighting device kit of parts of the invention is further characterized in that the cooling structure is in one piece with the lamp shade. Thus additional assembling steps in the manufacturing process are avoided and costs are saved.

An embodiment of the lighting device kit of parts is characterized in that the cooling structure is a cooling fin having a contour of its main surface alike the main heat dissipating surface. Fins are well-known shapes for efficient cooling and transfer of heat. By the fin having the shape according to the contour of the main heat dissipating surface of the heat sink a good mechanical and thermal contact between the cooling structure and the heat sink over essentially the full area of their main surfaces is enabled, and hence an efficient heat transfer from heat sink to cooling structure is enabled. An embodiment of the lighting device kit of parts is characterized in that the cooling structure comprises two fins with mutually opposed main surfaces, said fins having a respective contour of a respective main surface alike a contour of a respective main heat dissipating surface and adjoin the respective main heat dissipating surface on either side of the heat sink area. Hence, heat transfer from the heat sink to the cooling structure is doubled compared to the embodiment with a single fin. To further enhance the intimacy of said contact and enhancement of the heat transfer, an embodiment of the lighting device kit of parts is characterized in that the cooling structure abuts with its main surface with resilient/press force against the main heat dissipating surface of the heat sink area.

An embodiment of the lighting device kit of parts is characterized in that the heat sink area is clamped by the two fins. A simple, mutual mounting of the lamp shade and the lamp is then enabled by clamping the lamp shade with its cooling structure onto the heat dissipating surface of the heat sink.

Often it is convenient to be able to use the infrastructure already present in a building to mount the lighting device, for example to use the standard housing already present in a ceiling into which the lighting device of the invention can be mounted. Use of said standard housing brings several advantages, for example the leverage on the volume, and that use of 5 VA flammability rated plastics as safety covers is not a requirement anymore as it is rated as a lighting device and not as a retrofit kit, thus only needing a V0 rating. Then a low cost LED engine is feasible and hence the advantage of a relatively cheap lighting device is obtained. To be able to use said standard housing, it is often necessary to adapt the size of the lighting device to the size of the housing, in particular to adapt the height $H_{LD}$ of the lighting device to the distance between the electrical contact inside the housing (fitting) and the insertion opening, which relates to height H, of the housing. Thereto, and embodiment of the lighting device kit of parts is characterized in that the lamp and lamp shade are mutually shiftable along a lamp axis and/or lamp shade axis. Mutual mounting of the lamp and the lamp shade can then, for example, be realized via a socket of the lamp, for example, because of a slideable, snugly fit of the lamp shade with the socket of the lamp. Alternatively, mutual mounting can be obtained by a flexible intermediate element which compensates for the different distances H and $H_{LD}$ and/or for compensating the variable diameter of the socket. Still further alternatively, mutual mounting of lamp and lamp shade can be attained by the lamp shade being slidebly clamped with its cooling structure onto the heat dissipating structure. The cooling structure then not fully covering the heat dissipating main surfaces but being somewhat smaller thus enabling the cooling structure to slide over the heat dissipating structure via a sliding connection over a distance ΔL.

An embodiment of the lighting device kit of parts is characterized in that the cooling structure and the heat sink area have a similar shape. Not only the contours but also the perimeter of the respective main surfaces is similar, thus aiming at maximum heat transfer from heat sink to cooling structure by aimed maximal contact surface and thermal contact.

An embodiment of the lighting device kit of parts is characterized in that the cooling structure is surrounded by the lamp shade structure. For effective shielding the lamp, for example for reasons of avoiding glare, the lamp shade structure typically surrounds the lamp, leaving only open a light emission window through which light originating from the lamp is issued only in desired directions. Due to the adjacency of heat sink and cooling structure, the cooling structure in those embodiments is also surrounded by the lamp shade structure.

An embodiment of the lighting device kit of parts is characterized in that the light source is positioned adjacent the periphery of the heat sink area. If the light source is a plurality of LEDs, the LEDs can, for example, be arranged in a triangular, square, rectangular, elliptical or circular arrangement, for example to form an almost complete ring. The surface enclosed by the plurality of LEDs, for example a rectangular surface or a circle surface, can then be used as the main heat dissipating surface of the heat sink. This not only renders a compact construction of the lamp, but additionally renders the lamp to have an aesthetical attractive appearance.

An embodiment of the lighting device kit of parts is characterized in that the lamp shade is made in two similar halves. The two halves together form a complete lamp shade, which enables relatively easy mounting of the lamp. Additionally such a lamp shade is relatively easy to make as one halve of the lamp shade can be manufactured by using (combinations of) cheap sheet metal forming techniques like deep drawing, folding, die-cutting and stretching.

The invention further relates to a lamp having all the characteristics of the lamp of the lighting device kit of parts according to the invention and to a lamp shade having all the characteristics of the lamp shade of the lighting device kit of parts according to the invention.

BRIEF DESCRIPTION OF THE DRAWINGS

The invention will now be further elucidated by means of the schematic drawings in which.

As illustrated in the figures, the sizes of parts may be exaggerated for illustrative purposes and, thus, are provided to illustrate the general structures of embodiments of the present invention. Like reference numerals refer to like elements throughout.

DETAILED DESCRIPTION

Figure 1:
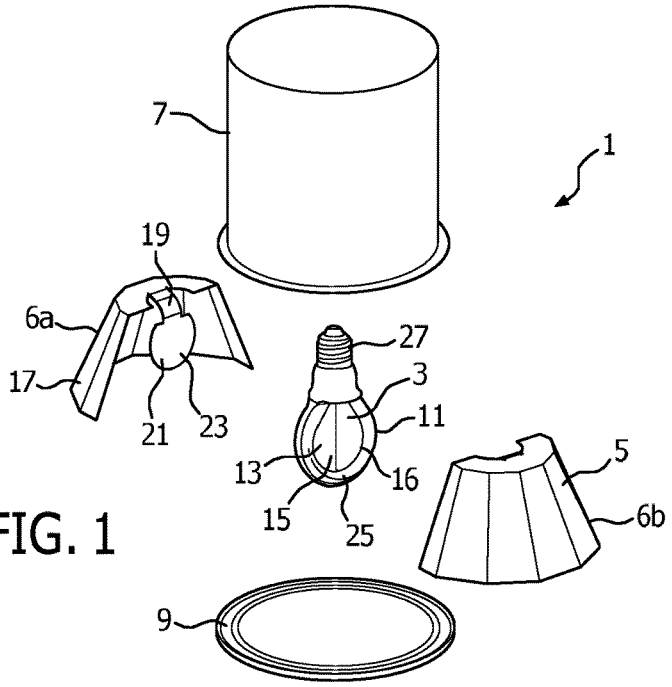
FIG. 1 shows an exploded view of a first embodiment of the lighting device kit of parts according to the invention.

FIG. 1 shows an exploded view of a first embodiment of the lighting device kit of parts 1 of the invention. The kit of parts comprises a lamp 3 and a lamp shade 5, which are housed inside a housing 7 by means of a fastening element 9, for example an optical plate or fastening ring 9. The lamp comprises a light source 11 and a heat sink area 13 comprising a main heat dissipating surface 15. The light source is a plurality of LEDs, in the figure arranged in a ring and enveloped by a circular, hollow tube 25 at the periphery 16 of main heat dissipating surface. The lamp shade, which is made into two similar halves 6*a*, 6*b*, comprises a shade structure 17 conjoined via a thermal path 19 with a cooling structure 21 comprising a main surface 23. The cooling structure is embodied as a fin which has a contour alike the contour of the main heat dissipating surface of the lamp. The lamp has an E27 socket 27, but the socket could have any suitable shape for mounting and electrical contacting with a respective fitting, for example a bayonet socket or a G53 socket.

Figure 2:
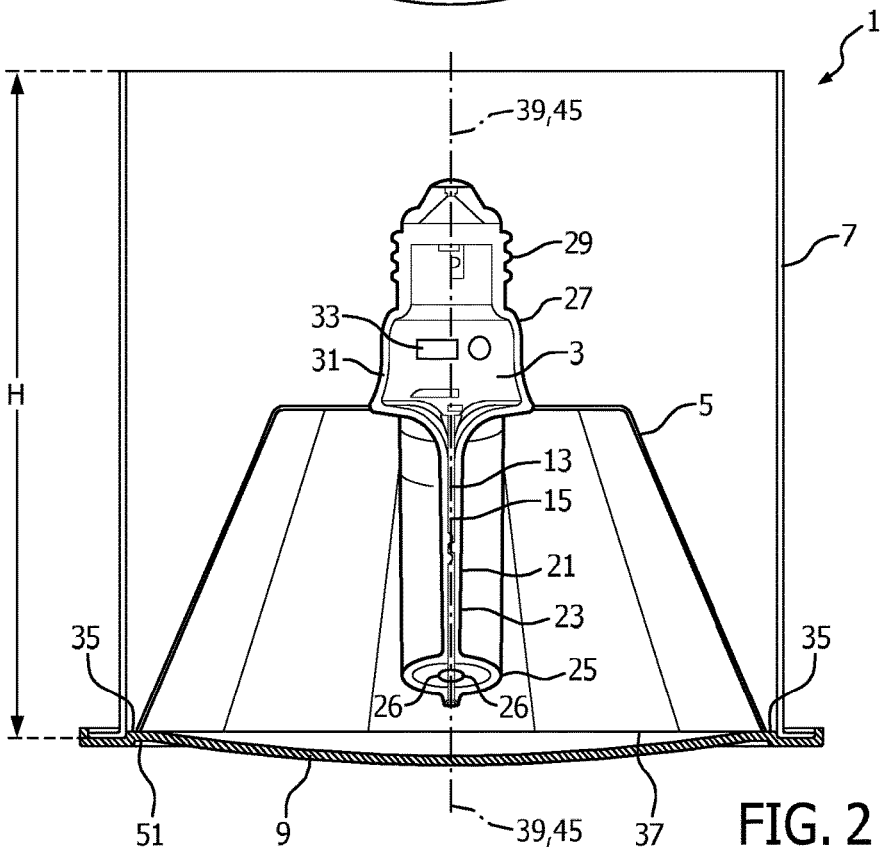
FIG. 2 shows a cross section of the assembled lamp of FIG. 1.

FIG. 2 shows a cross section of the assembled lighting device kit of parts 1 of FIG. 1 in a direction transverse to the main heat dissipating surface 15 of the lamp 3, in which a lamp shade axis 39 of the lamp shade 5 coincides with a lamp axis 45 of the lamp. As shown, in a mounted position of the lamp shade 5 and the lamp, the main surface 23 of the cooling structure 21 adjoins the main heat dissipating surfaces 15 of the heat sink area 13. The cooling structure, i.e. two fins, rests on both sides with its main surfaces with resilient force against said heat dissipating surfaces and hence the lamp shade is mounted with clamping force onto the lamp. The cross section clearly shows the hollow tube structure 25 which surrounds the light source 11, i.e. LEDs 26 in the figure, and which forms an integral part with a socket 27 of the lamp. The socket of the lamp comprises an E27 Edison base 29 by which it can be fitted into an E27 lamp fitting, and it comprises a socket housing 31 in which lamp electronics 33 for driving the LEDs is housed. Because the socket housing, and hence the lamp electronics, is arranged outside the lamp shade, the lamp electronics are even better shielded from the heat generated by the LEDs light source during operation.

The lamp is surrounded by the housing 7 having an insertion opening 51 and a height H, the lamp is attached to said housing via the lamp socket and via a rim 35 of the lamp shade. Said rim of the lamp shade forms a border of a light emission window 37 of the lamp via which light from the lighting device kit of parts 1 is (to be) issued to the exterior. Said light emission window is closed by a light transmitting plate 9, which light transmitting plate optionally can be provided with an optical structure on its main face facing the light source, for example meso-optical structure, to redistribute the light before being issued by the lighting device kit of parts. The lighting device kit of parts as shown in FIG. 2 is particularly suitable as a recessed lighting device for being built in into (false) ceilings.

Figure 3A:
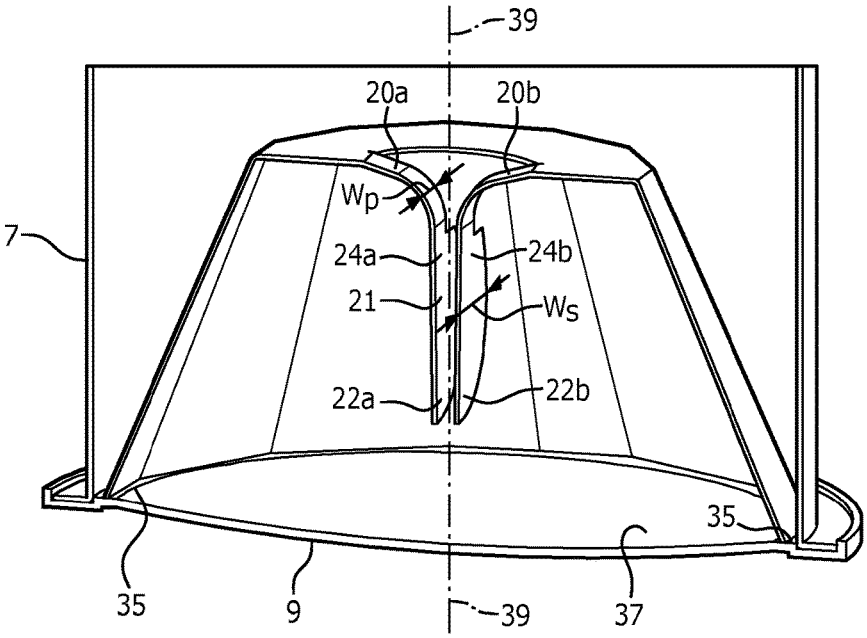
FIG. 3A-B shows a cross section of a lamp shade respectively a side view of a lamp of the lighting device kit of parts according to the invention.
Figure 3B:
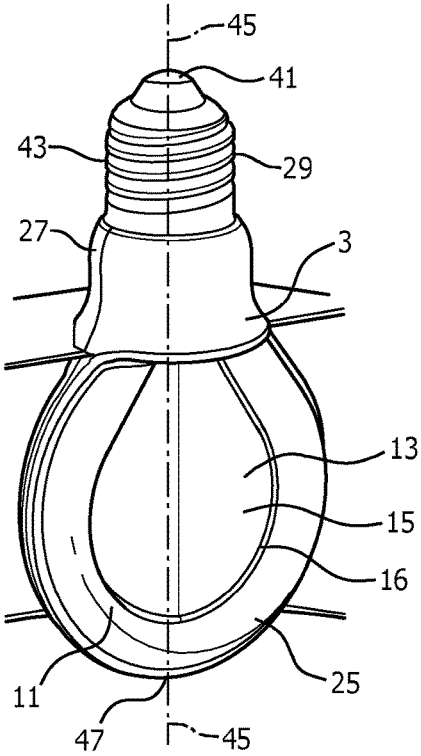

FIG. 3A-B shows a cross section of a lamp shade 5 respectively a side view of a lamp 3 of the lighting device kit of parts according to the invention. The lamp shade in FIG. 3A comprises a circumferential lamp shade structure 17 around a virtual lighting lamp shade axis 39, and comprises a cooling structure 21 of two similar halves 22*a*, 22*b*, i.e. with two main surfaces 24*a*, 24*b* which extend mutually parallel along the lamp shade axis. Each main surface is connected to the lamps shade via a respective thermal path part 20*a*, 20*b*. The lamp shade structure, the thermal path parts and the cooling structure are made in one, integral piece from thermal conductive material, in the figure made of aluminum metal. The thermal path has a cross-sectional width Wp transverse to the lamp shade axis which is about 40% of the largest cross-sectional width Ws transverse to the lamp shade axis of the main surface (only a half width of Wp and Ws is shown). The relatively large width of the thermal path enables a good heat transfer from the cooling structure to the shade structure, hence enabling the shade structure to function simultaneously as a lamp shade and cooling part. The lamp shade has a circumferential rim 35 which forms a border of a light emission window 37 of the lamp shade, and via which the lamp shade is attached to a housing 7 by means of an fastening element 9, in the figure an optical plate, or alternatively a fastening ring, which fastening element extends essentially transverse to the lamp shade axis.

The lamp 3 has hollow tube structure 25 at the periphery 16 of the main heat dissipating surface 15, said tube structure surrounds the LEDs and forms an integral part with a socket 27 of the lamp, i.e. the light source is arranged around the heat dissipating surface of the heat sink area. As is shown in the figure, the light source and the heat sink area are concentrically arranged with the light source arranged around the heat dissipating surface, preferably the periphery of the heat dissipating surface is at least over 75% surrounded by the light source, in the figure for about 90%. The socket of the lamp comprises an E27 Edison base 29 with a first, extreme central electrical contact 41, and a second, circumferential electrical contact 43 with a spiral-shaped outer surface for electrically contacting an E27 fitting when mounted there into. The lamp has a virtual lamp axis 45 which extends through the first extreme, central electrical contact of the socket, with the second electrical contact around said lamp axis. Said lamp axis further extending essentially parallel to main heat dissipating surface of the heat sink area 13 and through a tip portion 47 of the light source 11 most remote from the lamp socket. In assembled position of the lamp and the lamp shade both the virtual axis of the lamp shade and the virtual axis of the lamp extend essentially parallel or even coincide.

Figure 4:
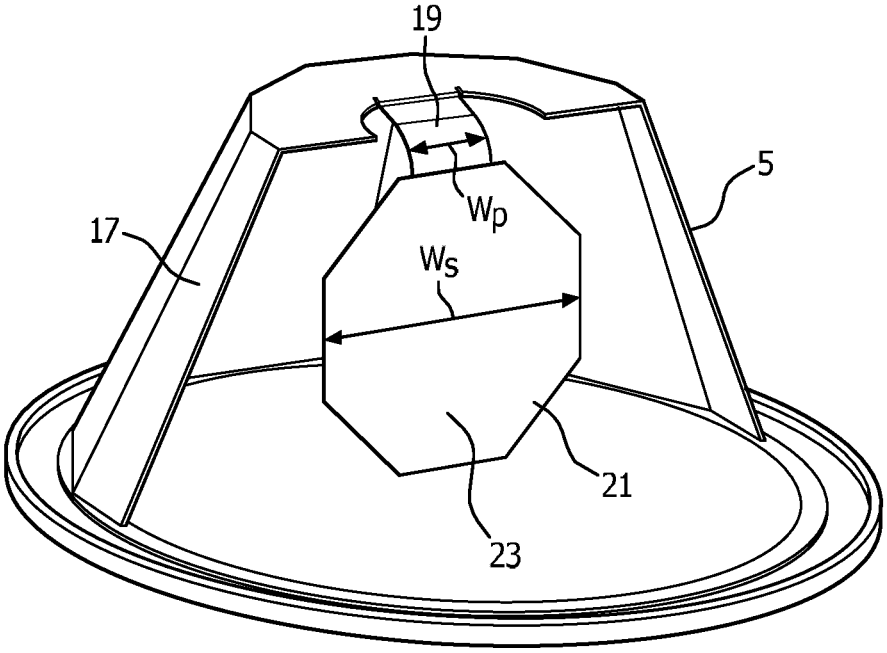
FIG. 4 shows a cross sectional view of lamp shade of a second embodiment of the lighting device kit of parts according to the invention.

FIG. 4 shows a cross sectional view of lamp shade 5 of a second embodiment of the lighting device kit of parts according to the invention. The cooling structure 21 of the lamp shade comprises a polygonal, in the figure an octagonal, main surface 23, which is adapted to snugly match with the main heat dissipating surface of the heat sink area of the lamp which thereto has an LEDs in an octagonal arrangement as the light source (not shown). Many other arrangements of the LEDs are envisaged, for example in a rectangular, hexagonal or two parallel line arrangement (either along or transverse to the axis of the lamp). The cooling structure of the lamp shade is connected to the lamp shade structure 17 via a thermal path 19 having a cross sectional width Wp which is about 25% of the largest cross-sectional width Ws of the main surface 23. The lamp shade structure and thermal path are made into one integral piece of aluminum metal to which the cooling structure, made of copper metal is, releasably fixed, for example via screws, thus enabling an exchange of the cooling structure, for example to adapt the cooling structure to an alternative lamp design.

Figure 5:
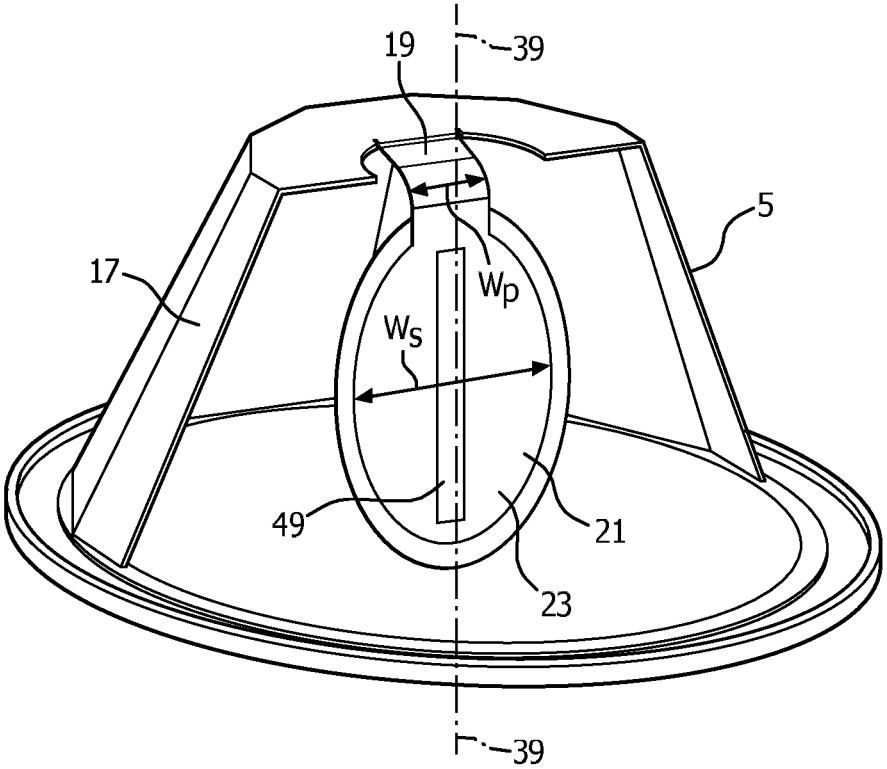
FIG. 5 shows a cross sectional view of lamp shade of a third embodiment of the lighting device kit of parts according to the invention.

FIG. 5 shows a cross sectional view of lamp shade 5 of a third embodiment of the lighting device kit of parts according to the invention in which the cooling structure 21 of the embodiment of FIG. 4 has been exchanged by an alternative cooling structure. The cooling structure of the lamp shade of the embodiment of FIG. 5 comprises a round, circular main surface 23, which is adapted to snugly match with the main heat dissipating surface of the lamp which thereto has an LEDs in a circular arrangement as the light source (not shown). In addition the cooling structure comprises an open slot 49 to enable accommodation of an additional central line arrangement of LEDs provided in the lamp along the lamp shade axis 39 (or lamp axis). Such an additional line of LEDs can be used for various purposes, for example to boost up the light output of the lamp or to be used as emergency lighting or for additional of extra color features or figurative features when directly viewed. The cooling structure of the lamp shade is connected to the lamp shade structure 17 via a thermal path 19 having a cross sectional width Wp which is about 30% of the largest cross-sectional width Ws of the main surface 23.

Figure 6:
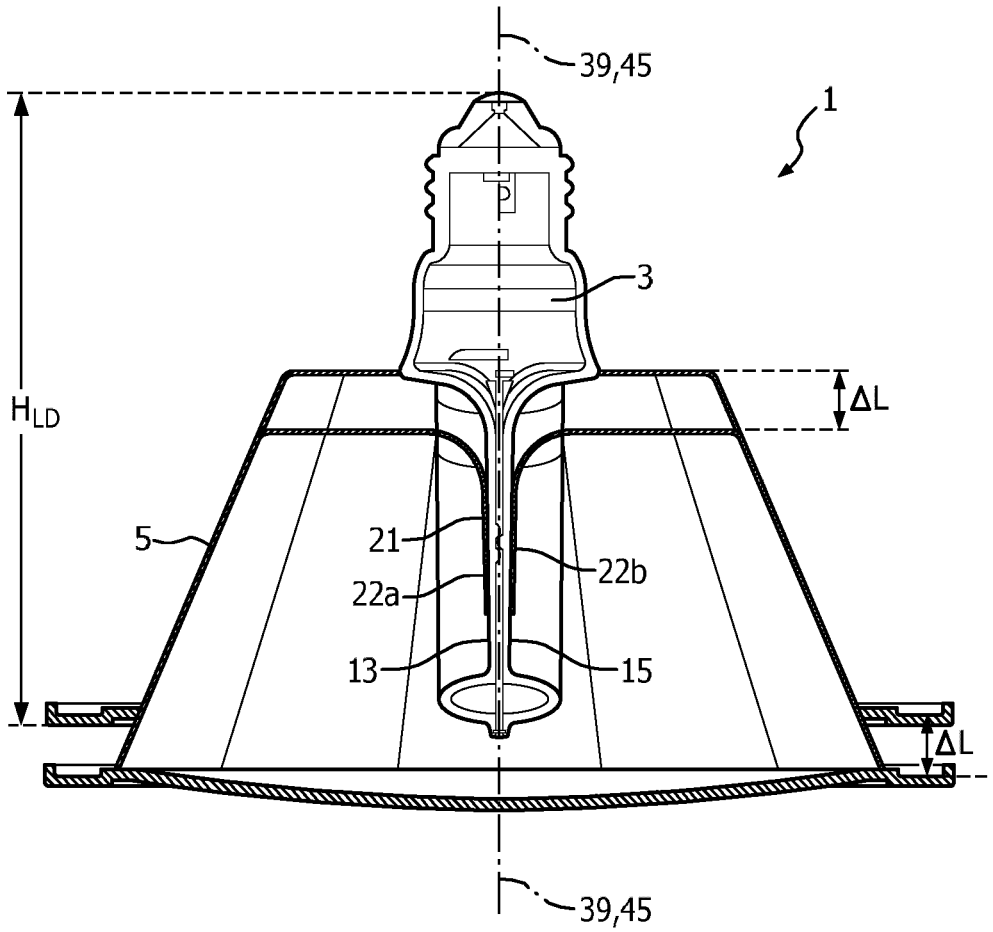
FIG. 6 shows a cross sectional view of a fourth embodiment of an assembled lamp.

FIG. 6 shows a cross section of a fourth embodiment of an assembled lighting device kit of parts 1 of a lamp 3 and a lamp shade 5 in a direction transverse to the main heat dissipating surface 15 of the lamp 3, in which a lamp shade axis 39 of the lamp shade coincides with a lamp axis 45 of the lamp. The lamp shade and the lamp are mutually mounted by the lamp shade being slidebly clamped with its cooling structure onto the heat dissipating surface of the heat sink. The figure shows schematically the lamp shade in a first position and in a second position shifted along the axes over a distance ΔL with respect to the lamp. The two halves 22*a*,22*b* of the cooling structure 21 then not fully covering the main heat dissipating surface but being somewhat smaller thus enabling said shift of ΔL of the cooling structure over the main heat dissipating surface of the heat sink area 13 via a sliding connection. Thus adaptation of the height $H_{LD}$ by a distance ΔL of the lighting device along the lamp axis/lamp shade axis to the height H of the housing (not shown) is enabled.

The invention claimed is:

1. A lighting device kit of parts forming a lighting device comprising:

a lamp comprising a light source and a heat sink area comprising a main heat dissipating surface;

a lamp shade comprising a shade structure conjoined via a thermal path with a cooling structure comprising a main surface;

in a mounted position of the lamp shade and the lamp, the main surface of the cooling structure adjoins the main heat dissipating surface of the heat sink area, and the light source is arranged around the heat dissipating surface, wherein the cooling structure comprises two fins with mutually opposed main surfaces, said fins having a respective contour of a respective main surface, corresponding to a contour of a respective main heat dissipating surface, and adjoin the respective main heat dissipating surface on either side of the heat sink area.

2. A lighting device kit of parts as claimed in claim 1, characterized in that the thermal path has a cross-sectional width Wp which is at least 25% of the largest cross-sectional width Ws of the main surface of the cooling structure.

3. A lighting device kit of parts as claimed in claim 1 or 2, characterized in that the cooling structure is in one piece with the lamp shade.

4. A lighting device kit of parts as claimed in claim 1, characterized in that the cooling structure abuts with its main surface with force against the main heat dissipating surface of the heat sink area.

5. A lighting device kit of parts as claimed in claim 1, characterized in that the heat sink area is clamped by the two fins.

6. A lighting device kit of parts as claimed in claim 1, characterized in that the cooling structure and the heat sink area have a similar shape.

7. A lighting device kit of parts as claimed in claim 1, characterized in that the cooling structure is surrounded by the lamp shade structure.

8. A lighting device kit of parts as claimed in claim 1, characterized in that the light source is concentrically arranged around the heat sink area.

9. A lighting device kit of parts as claimed in claim 1, characterized in that the lamp shade is made in two similar halves.

10. A lighting device kit of parts as claimed in claim 1, characterized in that the lamp and lamp shade are mutually shiftable along a lamp axis.

11. A lighting device kit of parts as claimed in claim 1, characterized in that the surface of lamp shade facing the light source has a reflectivity of at least 80%.

12. A lamp shade having all the characteristics of the lamp shade of the lighting device kit of parts as claimed in claim 1.

* * * * *